US011578525B2

(12) United States Patent
Williams et al.

(10) Patent No.: US 11,578,525 B2
(45) Date of Patent: Feb. 14, 2023

(54) DOOR OPERATOR WITH ISOLATED COMPONENTS

(71) Applicant: GMI Holdings, Inc., Mt. Hope, OH (US)

(72) Inventors: Gregory E. Williams, Minerva, OH (US); Walter Dennis Reber, Alliance, OH (US)

(73) Assignee: GMI HOLDINGS, INC., Mount Hope, OH (US)

( * ) Notice: Subject to any disclaimer, the term of this patent is extended or adjusted under 35 U.S.C. 154(b) by 122 days.

(21) Appl. No.: 17/175,035

(22) Filed: Feb. 12, 2021

(65) Prior Publication Data

US 2022/0259913 A1 Aug. 18, 2022

(51) Int. Cl.
*E05D 15/48* (2006.01)
*E05F 15/686* (2015.01)

(52) U.S. Cl.
CPC ..... *E05F 15/686* (2015.01); *E05Y 2201/434* (2013.01); *E05Y 2201/652* (2013.01); *E05Y 2201/668* (2013.01); *E05Y 2201/684* (2013.01); *E05Y 2600/452* (2013.01); *E05Y 2900/106* (2013.01)

(58) Field of Classification Search
CPC ..... E05Y 15/686; E05Y 2201/434; E05Y 2201/652; E05Y 2201/668; E05Y 2201/684; E05Y 2600/452; E05Y 2900/106
USPC ..... 49/199
See application file for complete search history.

(56) References Cited

U.S. PATENT DOCUMENTS 3,481,074 A 12/1969 Moss
3,764,875 A 10/1973 Harris
3,816,782 A 6/1974 Dow et al.
3,979,977 A * 9/1976 Dorma ..... E05D 13/1261 81/57.13
4,885,872 A 12/1989 Chang et al.
5,010,688 A 4/1991 Dombrowski et al.
5,221,869 A 6/1993 Williams et al.
(Continued)

FOREIGN PATENT DOCUMENTS

WO 2018217332 A1 11/2018

OTHER PUBLICATIONS

The Chamberlain Group, Inc., Premium Series 3240 1/2 HP Screw Drive Garage Door Opener, 2007 LM 3240 06/07, Elmhurst, IL, (publication date unknown).

*Primary Examiner* — Jerry E Redman
(74) *Attorney, Agent, or Firm* — Haynes and Boone, LLP

(57) ABSTRACT

A movable barrier operator includes a first side panel having a first opening and a second side panel, opposing the first side panel, where the second side panel has a second opening. The operator further includes a motor having a first side and an opposing second side including a first shaft extending in a first direction and a second shaft of the motor extending in a second opposite direction. The operator further includes a first bearing, the first bearing inserted into the first opening of the first side panel, wherein the first shaft of the motor is inserted through the first bearing and a second bearing, the second bearing inserted into the second opening of the second side panel, wherein the second shaft of the motor is inserted through the second bearing to thereby prevent transfer of vibration from the motor to the second side panel.

19 Claims, 8 Drawing Sheets

(56) References Cited

U.S. PATENT DOCUMENTS 5,299,678 A * 4/1994 Chang ..... E05F 15/668 192/142 R
5,568,704 A 10/1996 Williams et al.
5,664,372 A 9/1997 Williams et al.
5,761,850 A 6/1998 Lhotak et al.
6,155,324 A * 12/2000 Elliott ..... E06B 9/68 160/133
6,847,136 B2 1/2005 Mattson
6,952,061 B2 10/2005 Mogi et al.
7,061,197 B1 6/2006 Mullet et al.
7,275,631 B2 * 10/2007 Hsieh ..... E06B 9/82 188/164
7,282,883 B2 10/2007 Mullet et al.
7,296,607 B2 * 11/2007 Krupke ..... E05D 13/1261 160/193
7,576,504 B2 8/2009 Mullet et al.
7,592,726 B2 9/2009 Heyder
7,878,931 B2 * 2/2011 Angiuli ..... E05F 15/603 474/167
8,381,442 B2 * 2/2013 Wan ..... E05F 15/603 49/140
8,484,897 B2 * 7/2013 Hsieh ..... E06B 9/74 160/8
8,590,209 B1 * 11/2013 Skotty ..... E05F 15/59 49/200
8,662,140 B2 * 3/2014 Hsieh ..... E05F 15/681 160/310
8,893,435 B2 * 11/2014 Nicholson ..... E06B 9/74 49/139
8,985,181 B2 * 3/2015 Hsieh ..... E06B 9/68 160/310
9,038,800 B2 5/2015 Dang
9,234,377 B2 1/2016 Schatz et al.
9,376,864 B2 * 6/2016 Hsieh ..... E06B 9/08
9,890,575 B2 2/2018 Tehranchi
10,000,960 B2 6/2018 Angiuli et al.
10,563,446 B2 2/2020 Tehranchi
2005/0172559 A1 * 8/2005 Hsieh ..... E05F 15/40 49/140
2006/0265956 A1 * 11/2006 Angiuli ..... E05F 15/603 49/32
2007/0075665 A1 * 4/2007 Claudel ..... E05F 15/70 318/16
2007/0200519 A1 * 8/2007 Murphy ..... E05F 15/686 318/280
2011/0105262 A1 * 5/2011 Angiuli ..... E05F 15/603 474/150
2013/0074409 A1 * 3/2013 Hsieh ..... E06B 9/80 49/139

* cited by examiner

DOOR OPERATOR WITH ISOLATED COMPONENTS

TECHNICAL FIELD

The present disclosure relates generally to movable barrier opener systems for opening and closing garage doors, gates, and other movable barriers, in particular to movable barrier opener systems including jackshaft or hoist operators.

BACKGROUND

Movable barriers, such as upward-acting sectional or single panel garage doors, residential and commercial rollup doors, and slidable and swingable gates, are used to alternatively allow and restrict entry to building structures and property. These barriers are driven between their respective open and closed positions by motors or other motion-imparting mechanisms, which are themselves controlled by barrier moving units, sometimes referred to as "movable barrier operators," and in the specific case of a door, as "door operators," and in the even more specific case of a garage door, as "garage door operators." Garage door operators are effective to cause the DC or AC motor, and accompanying motor drive assembly, to move the associated garage door, typically between its open and closed positions.

Garage door operators and movable barriers create noise during normal operation. For example, the movement of the mechanical portions of the operator and the movable barrier create noise as the barrier moves. Moreover, noise can come from other different parts of the system. For example, the motor drive assembly generally includes steel frame members to which the motor is directly mounted. Generally, the motor of an operator creates vibrations during operation. These vibrations can be magnified by the steel frame members of the drive assembly thereby creating more noise.

Additionally, the operator motor can be attached to drive a belt or chain drive on one side of the motor drive assembly. Driving the belt or chain drive can create a radial load on the motor of the operator. This radial loading can create a force that pulls the rotor off center, creating more vibrations, and increasing the overall the noise level. Furthermore, different components, such as for example, an electrical box, may be mounted to the motor drive assembly. The additional components can amplify the vibrations of the motor and motor drive assembly. Other mechanical interfaces, such as hardware used to disengage the operator for manual operation, can provide additional sources of vibration and noise.

This disclosure is directed to a reduced noise and vibration door operator that addresses these and other shortcomings of conventional systems.

SUMMARY

In an example aspect, the present disclosure is directed to an operator having a structural arrangement that may produce less vibration than conventional operators, thereby reducing overall operating noise from the operator. In some example implementations, the operator may include an electric box mounted to a chassis with the chassis including a motor, a drive belt, and drive chain operable to open and close a movable barrier, such as, for example, a garage door.

In an aspect, an operator chassis may include a motor mounted to a metal frame through bearings that are seated within the metal frame. In aspect, the motor may include a double ended shaft, each shaft end being mounted to opposing sides of the metal frame. In an aspect, a belt pulley may be installed over one of the motor shafts, operable to drive a belt and operable to resist axial movements from the motor. In an aspect, vibration dampening washers may be installed between the belt pulley and the bearing. In an aspect, a set collar may be installed over the other motor shaft, operable to resist axial movement from the motor. In an aspect, vibration dampening washers may be installed between the set collar and the bearing. In an aspect, a stud may be installed on the motor and inserted in a slot in the metal frame, the stud being operable to resist rotation of the motor within the frame. In an aspect, the belt pulley may drive a tensioned belt connected around the belt pulley and a transfer belt pulley. In an aspect, the load of the tensioned belt may be supported by the metal frame through the bearings installed over the motor shaft, thereby reducing a radial load on the motor caused by the tensioned belt.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, explain the principles of the present disclosure.

Figure 1:
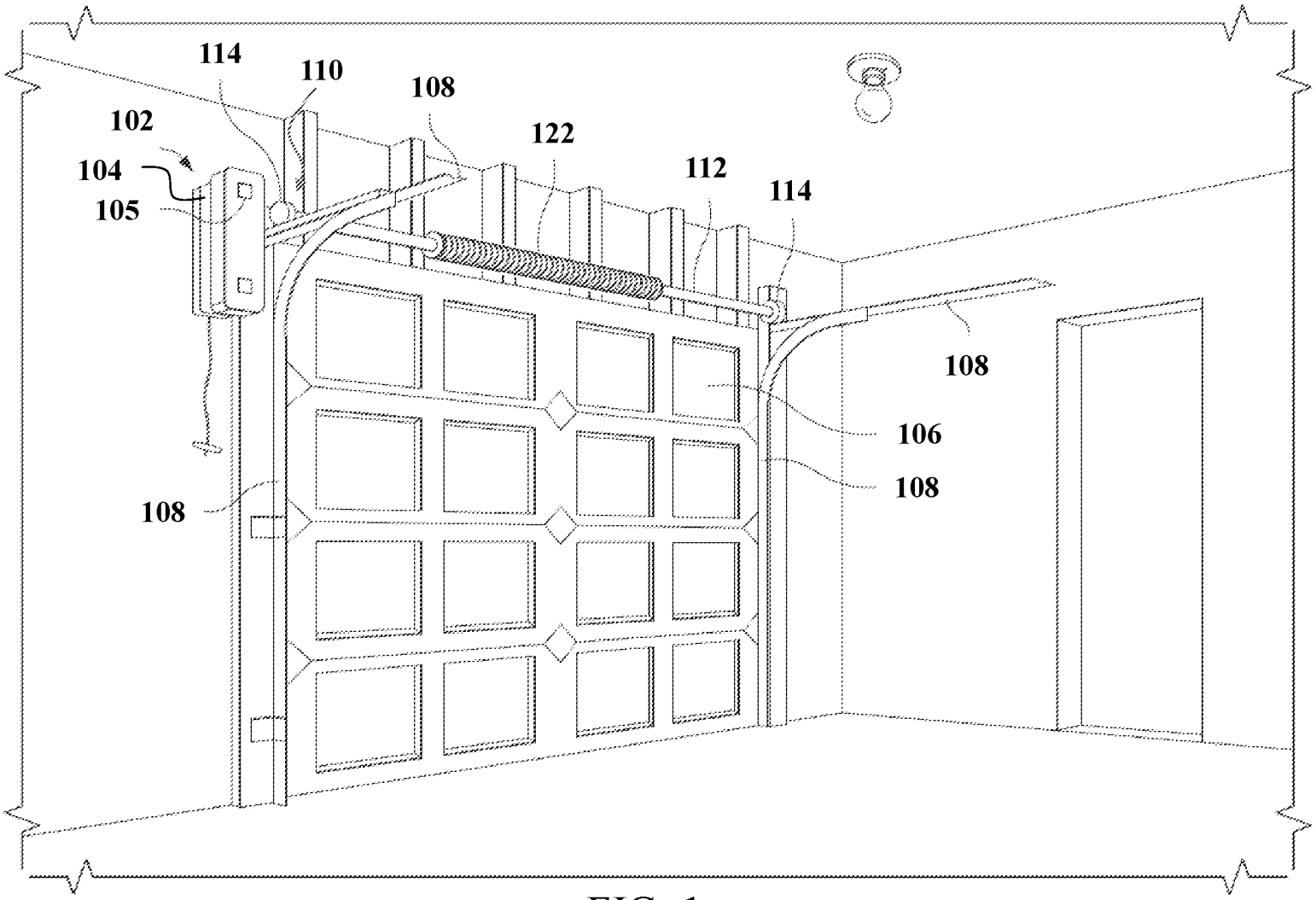
FIG. 1 is a perspective illustration of material structural components of a jackshaft operator installed in a garage with a sectional type garage door, according to one example implementation.

These Figures will be better understood by reference to the following Detailed Description.

DETAILED DESCRIPTION

For promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

Figure 2:
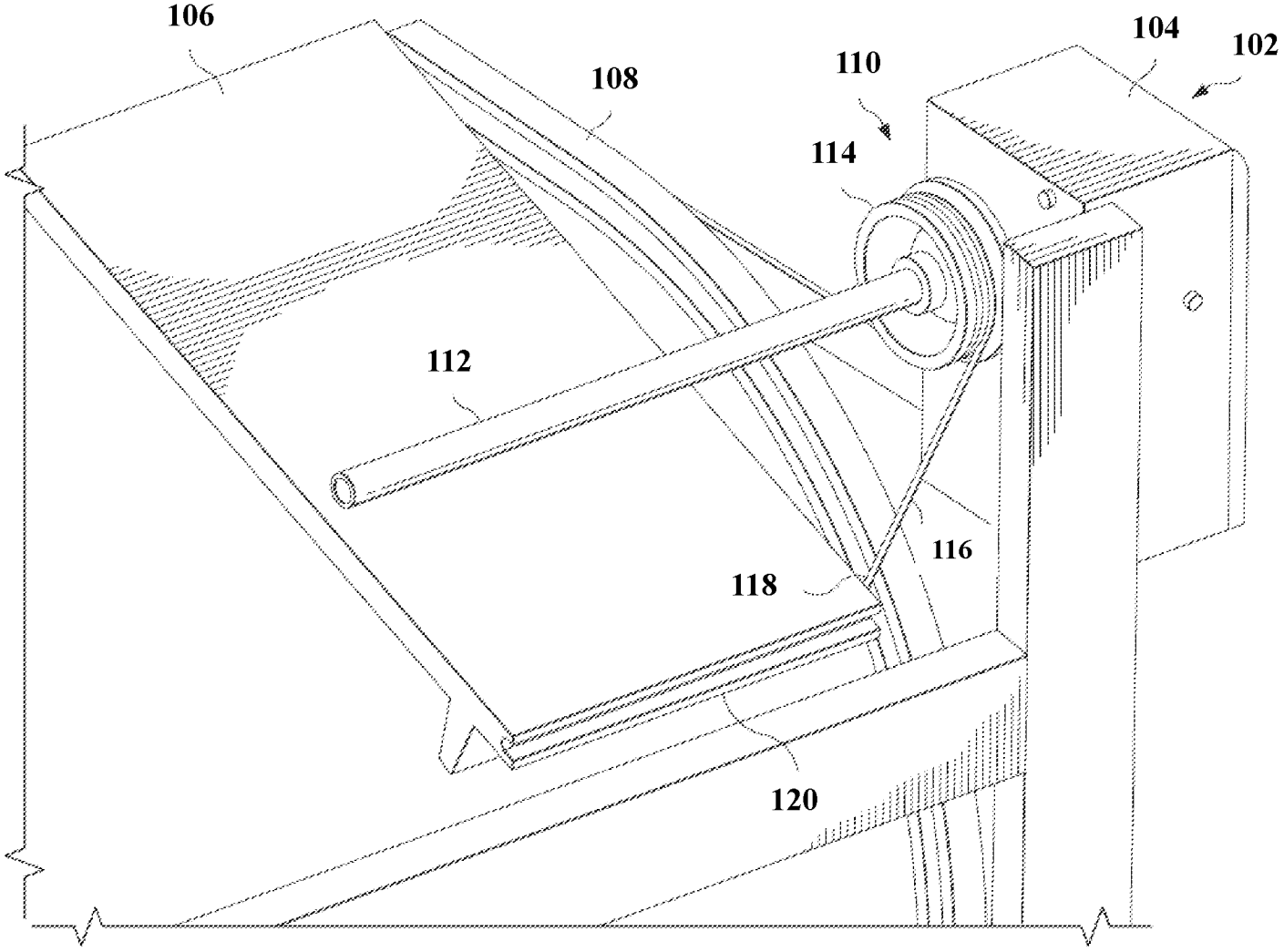
FIG. 2 is a perspective illustration of a jackshaft operator installed to move a single panel type garage door, according to one example implementation.

With initial reference to FIGS. 1 and 2, there are depicted perspective illustrations of the material structural components for moving a garage door according to some embodiments of the present disclosure. Each of FIGS. 1 and 2 shows an example jackshaft operator 102, including a chassis 104 and an electric box 105, operable to move a garage door 106 along guide rails 108 to open and close the garage door 106. FIG. 1 illustrates the garage door 106 as a conventional upward acting sectional door being moved between open and closed positions along guide rails 108. FIG. 2 illustrates the garage door 106 as a conventional single panel door being moved between open and closed positions along guide rails 108. In some embodiments, the operator 102 may be a jackshaft operator. In some embodiments, the operator 102 may be a hoist operator. In some embodiments, not depicted, the operator 102 may be a trolley operator.

The chassis 104 encloses a jackshaft motor assembly. The electric box 105 encloses a door control module and an operator control module. The jackshaft motor assembly includes, among other components, (i) a motor adapted to move the garage door in the conventional manner known by one of ordinary skill in the industry, and (ii) an absolute position sensor that monitors or measures rotation of the output shaft of the motor and communicates signals based on the measurements indicative of, the extent and direction of rotation of the rotatable output shaft of the motor, and therefore indicative of the extent and direction of travel of the garage door 106 between travel limits.

As best seen in FIG. 2, the motor is operatively coupled to a drive assembly 110. The motor and drive assembly 110 are effective to impart movement to the door 106 in accordance with door commands remotely and/or proximately transmitted to operator control module and thereafter to the motor. The drive assembly 110 may be any of the standard and conventional drive assemblies available on the market that are suitable to move the garage door 106 in response to the motor. In the example described herein, the drive assembly 110 is a part of a jackshaft drive assembly.

The jackshaft operator 102 is installed adjacent a garage door 106 and operable to open and close the garage door. The chassis 104 of the operator 102 is shown adjacent the motor drive assembly 110 which may include a torsion tube 112 and one or more cable drums 114 rigidly affixed to the torsion tube 112. These may be rotatably driven by the operator 102. One or more cables 116 may be wound about the cable drums 114 and have their free ends 118 attached at or adjacent a bottom edge 120 of the door 106. In some embodiments, the torsion tube 112 forms a part of or is coaxial with the motor shaft of the operator 102. In other embodiments, the torsion tube 112 may be laterally offset from the motor shaft of the operator 102 and use a chain and sprockets to couple the operator 102 to the torsion tube 112. Rotation of the output shaft of the operator 102 rotates the torsion tube 112 and the cable drums 114. Rotation in a direction to wind the cable around the cable drums 114 results in the door 106 being raised to the open position.

In this embodiment, the torsion tube 112 of the motor drive assembly 110 extends horizontally and is directly coupled to, and adapted to be rotatably driven by, the operator 102 in either a clockwise or counterclockwise direction. A torsion spring 122 extends around the torsion tube 112.

When the operator 102 is instructed by a controller to open the garage door 106, the torsion tube 112 and the connected cable drums 114 are rotated by the operator 102 in a direction so as to wind the cable(s) 116 onto the cable drum(s) 114, thereby lifting the garage door 106 to its open position. When the operator 102 is instructed by the controller to close the door 106, the torsion tube 112 and connected cable drums 114 are rotated by the operator 102 in the opposite direction so that cable(s) 116 may be payed out, thereby permitting the door 106 to be closed. The torsion spring 122 provides a counterbalance to aid in the door 106 being moved to its closed position.

Figure 3:
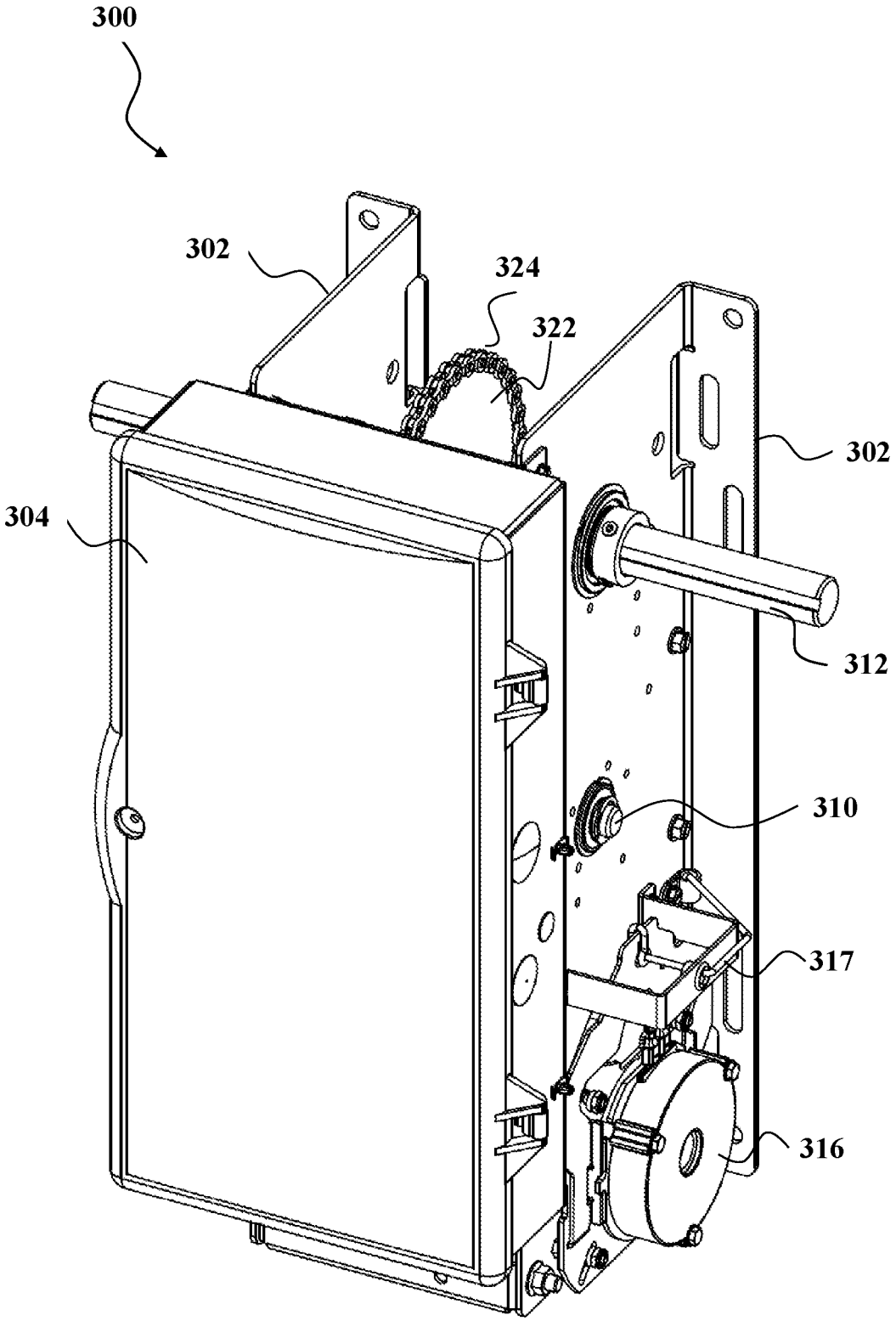
FIG. 3 is a perspective illustration of a jackshaft motor drive assembly for moving a movable barrier, according to one example implementation.
Figure 4:
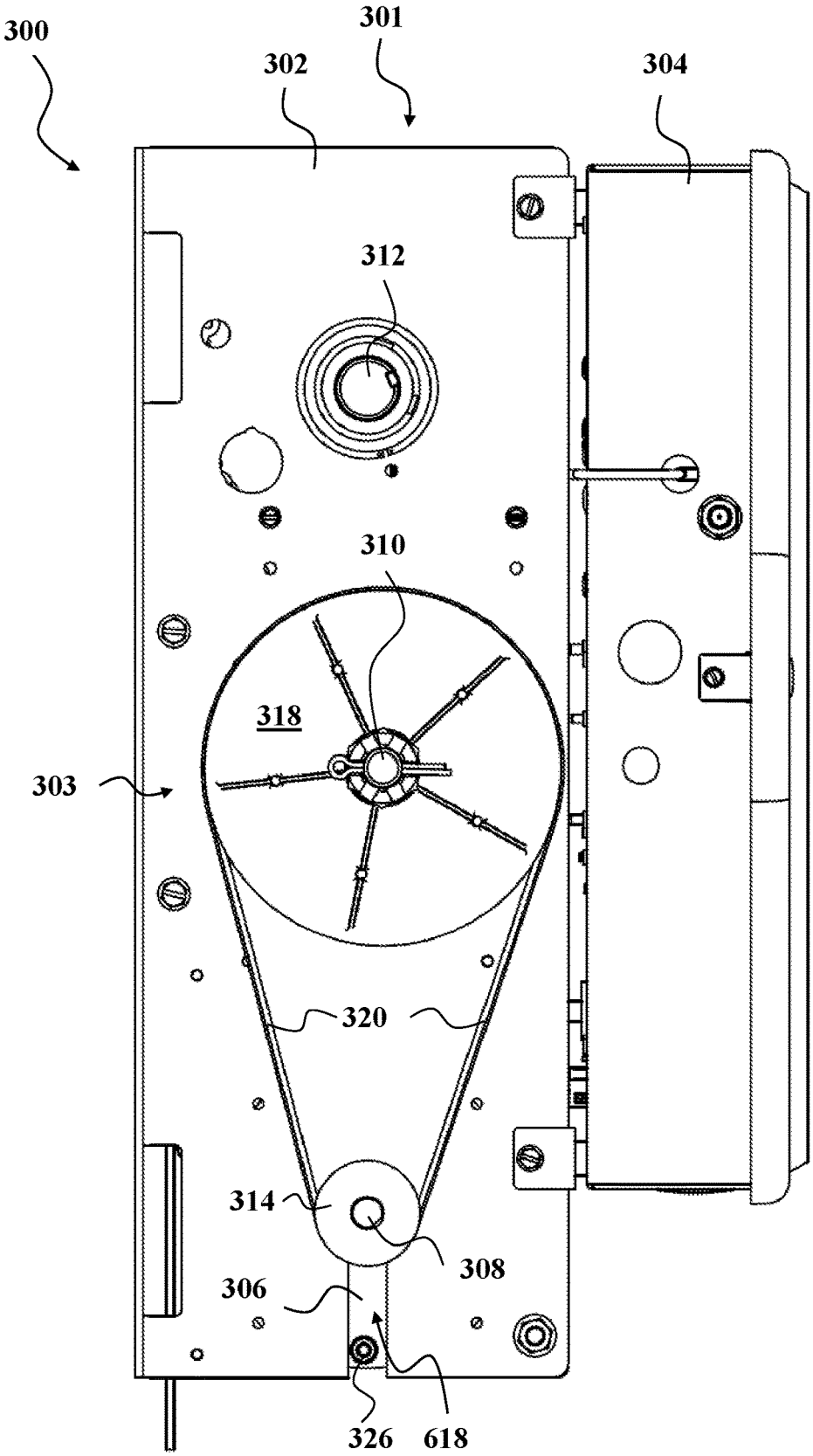
FIG. 4 is a side illustration of a jackshaft motor drive assembly for moving a movable barrier, according to one example implementation.
Figure 5:
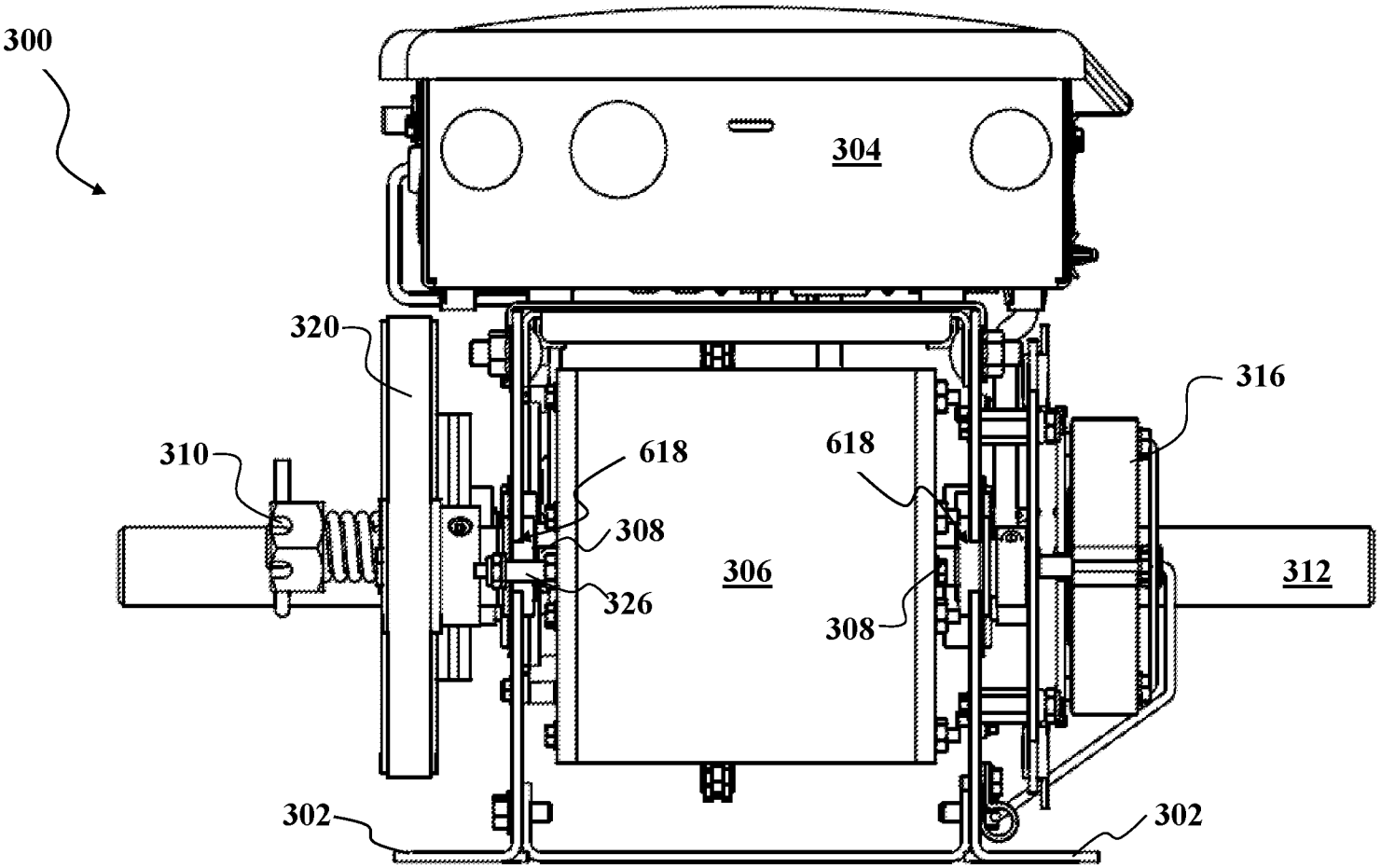
FIG. 5 is a bottom illustration of a jackshaft motor drive assembly for a moving movable barrier, according to one example implementation.

With reference to FIGS. 3, 4, and 5 there are depicted a perspective view, a side view, and a bottom view of an exemplary jackshaft operator 300 according to some embodiments of the present disclosure. The jackshaft operator 300 may be the operator 102 in FIGS. 1 and 2 or may be a different operator. In the depicted embodiment, the jackshaft operator 300 includes a chassis 301 including side panels 302 for mounting the various components of a motor assembly and an electric box 304 mounted to side panels 302. In some embodiments, side panels 302 may be metal panels including mounting points and holes configured to receive the different components of the operator. In some embodiments, the side panels 302 may be sheet metal. The motor assembly 303 may include a motor 306 having a motor shaft 308, a belt transfer shaft 310, and an output shaft 312. In some embodiments, the motor 306 may have dual motor shafts 308. The output shaft 312 may be coupled to torsion tube 112 (FIG. 1) for operating the garage door 106. In some embodiments, the output shaft 312 may directly connected to torsion tube 112. In some embodiments, the output shaft 312 may be coupled to torsion tube 112 by a chain or belt mechanism. The motor 306 is mounted between bottom portions of the side panels 302. A motor belt pulley 314 is coupled to one of the motor shafts 308 of the motor 306. A brake 316 is coupled to the motor shaft 308 of motor 306. A brake release mechanism 317 is connected to the brake 316 operable to release the brake to allow for manual operation of the door. In some embodiments, the motor belt pulley 314 may be mounted one side of the jackshaft operator 300, such as for example the left side. In some embodiments, the motor belt pulley 308 may be mounted on the other side of the jackshaft operator 300, such as for example the right side. The side on which the motor belt pulley 314 is installed may be determined by where the operator 300 is installed. An anti-rotation stud 326 may prevent the motor from rotating within the chassis during operation of the operator 300.

A belt transfer pulley 318 is coupled to the belt transfer shaft 310 with a belt 320 that is wrapped around the belt transfer pulley 318 and the motor belt pulley 314. A belt transfer shaft sprocket is coupled to the belt transfer shaft 310 between the sidewalls 302 of the chassis. A jackshaft sprocket 322 is coupled to the output shaft 312 between the sidewalls 302 of the chassis and a chain 324 is wrapped around the jackshaft sprocket 322 and the belt transfer shaft sprocket. As the motor 306 rotates the motor shafts 308, the belt 320 rotates the belt transfer shaft 310 which in turn causes the chain 324 to rotate the output shaft 312. The output shaft 312 being coupled to the torsion tube 112 for operating the garage door 106.

According to some embodiments, belt 320 may be a self-tensioning belt having a loaded tension of up to 100 lbs. In some embodiments, the tension on belt 320 may be between about 60 lbs. and about 100 lbs. Other tension amounts, both higher and lower are contemplated. As will be discussed in more detail below, the load of the belt 320 is carried by side plates 302 instead of the motor shaft 308. In this way, vibrations from the motor 306 caused by a radial load of the belt 320 are reduced. Furthermore, this configuration reduces contact points between the motor 306 and side plates 302. This reduction in vibration and contact points may produce less noise that may result in a quieter system as compared to previous designs.

Figure 6:
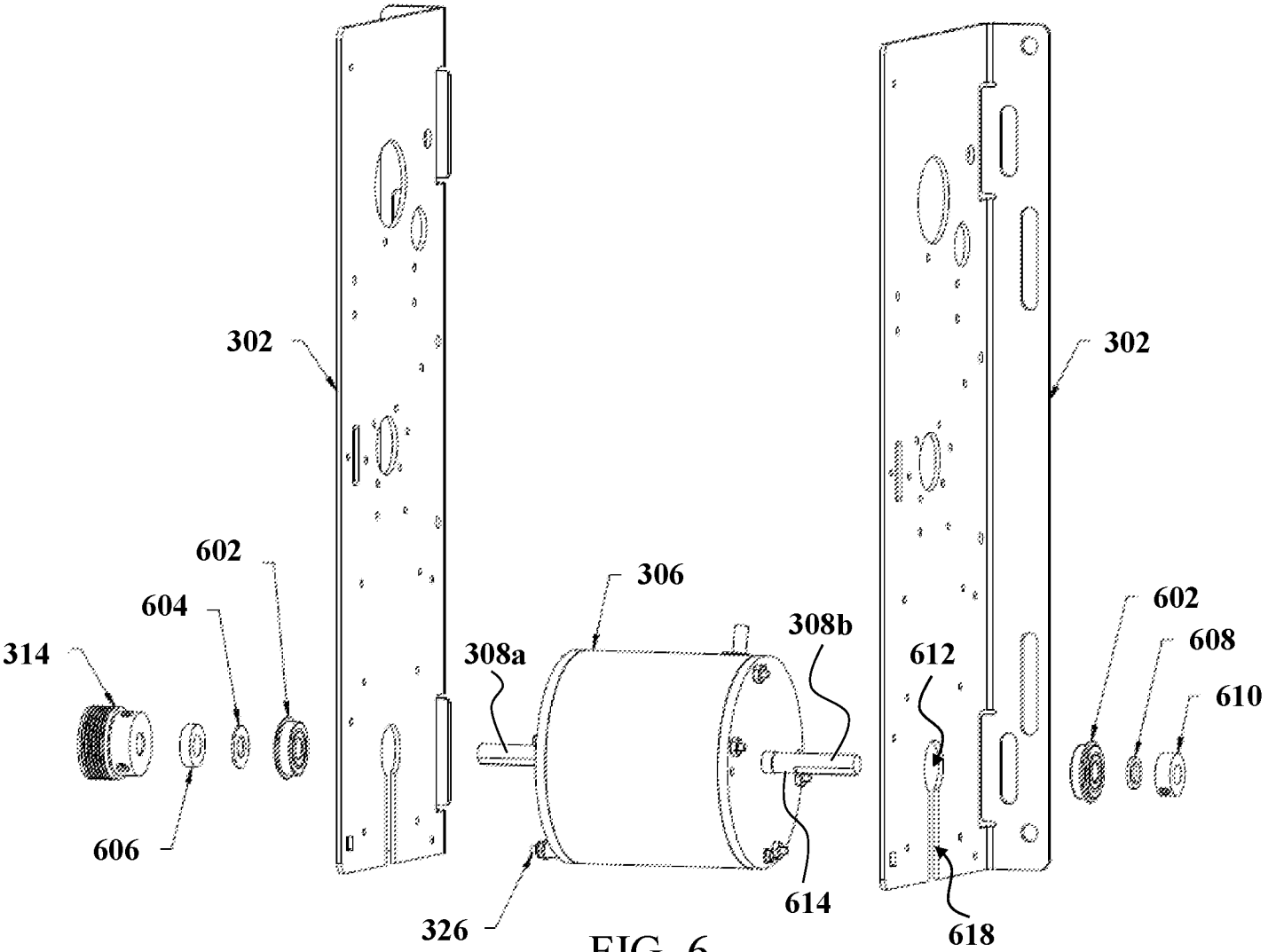
FIG. 6 is an exploded perspective illustration of motor mount components for a jackshaft motor drive assembly, according to one example implementation.
Figure 7:
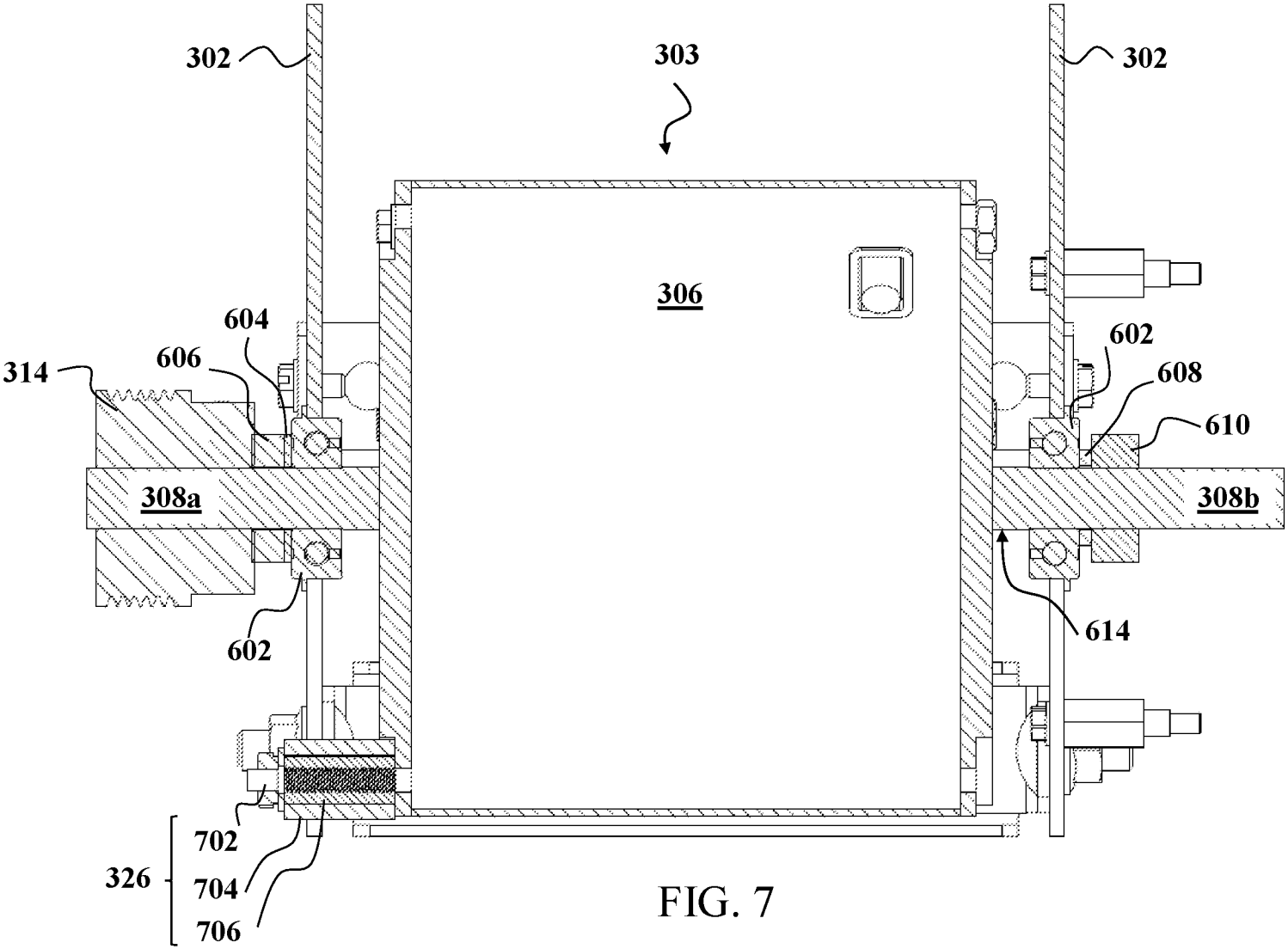
FIG. 7 is a cross section illustration of motor mount components assembled for a jackshaft motor drive assembly, according to one example implementation.

FIGS. 6 and 7 depict an exploded perspective view and an assembled cross section view of motor mount components for an exemplary jackshaft motor assembly 303 that may reduce vibration and noise. As depicted in FIGS. 6 and 7, the motor 306 is mounted between side panels 302. In the example implementation shown, the motor 306 is a dual shaft motor having motor shafts 308*a* and 308*b* extending from motor 306. A dual shaft motor may provide benefits over a single shaft motor. For example, it may enable separation of the driving and braking mechanisms. As illustrated above with respect to FIGS. 3-5, the belt 320 may be on one side of the motor and the braking components on the other side of the motor 306, thereby reducing potential contact points between components and lower noise created by those contacts. According to some embodiments of the present disclosure, the motor belt pulley 314 may be mounted on either side of the motor. In the illustrated embodiment, the motor belt pulley 314 is mounted on motor shaft 308*a*. In other embodiments, the motor belt pulley 314 may be mounted on motor shaft 308*b*, or in other words, the opposite side of the motor 306 and therefore the opposite side of the operator 300.

According to the illustrated embodiment, motor shaft 308*a* is secured to the side panel 302 by a bearing 602, a washer 604, a washer 606, and motor belt pulley 314 while motor shaft 308*b* is secured to side panel 302 by a bearing 602, a washer 608, and a set collar 610. In this way, the motor 306 is coupled to the side panels 302 using bearings 602. The bearing 602 fits inside an opening 612 formed in the side panel 302 on each side of the motor 306. In some embodiments, a flange on the outer surface of bearing 602 may provide tension holding side panels 302 in alignment and may prevent bearing 602 from sliding through opening 612. An opening in the bearings 602 allows the bearings 602 to fit over the motor shaft 308*a*, 308*b* when bearing 602 is seated in opening 612. In some embodiments, the motor shafts 308*a*, 308*b* each include a diameter change as a step 614 that provides clearance between bearing 602 and motor 306. In some embodiments, the larger diameter portion between the motor 306 and the step 614 may extend from the body of motor 306 and along the motor shaft 308*a*, 308*a* and have a length between about 20 millimeters and about 30 millimeters. In some embodiments, the step 614 prevents the motor 306 from contacting side panels 302 and allows the motor 306 to self-center between side panels 302. That is, the step 614 may abut against the bearings 602 that fit within the openings 612 to thereby maintain the motor 306 central between the side panels 302. In some embodiments, step 614 saves time during assembly of the jackshaft operator 300 allowing motor 306 to self-center and therefore lowers assembly costs. In some embodiments, step 614 is not present.

Mounting the motor 306 on the side of motor shaft 308*b* is accomplished by placing the washer 608 over motor shaft 308*b* adjacent to bearing 602 so that bearing 602 is between washer 608 and the motor 306. In some embodiments, washer 608 may be made of a strong, lightweight material that is resistant to friction. In some embodiments, washer 608 may be a nylon washer. Set collar 610 is disposed over motor shaft 308*b* adjacent to washer 608 such that washer 608 is between bearing 602 and set collar 610 and washer 608 and prevents contact between bearing 602 and set collar 610. In some embodiments, set collar 610 may include a hole to insert a set screw to hold set collar 610 in place on motor shaft 308*b*. The set screw may be inserted into the hole and tightened until it presses against the motor shaft 308*b* thereby holding set collar 610 in place. In some embodiments, the set screw may tighten against any portion of the motor shaft 308*b*. In some embodiments, motor shaft 308*b* may include a feature specifically designed to receive the set screw, such as for example a groove or a flat surface.

Mounting the motor 306 on the side of motor shaft 308*a* is accomplished by placing the washer 604 over motor shaft 308*a* adjacent to bearing 602 so that bearing 602 is between washer 604 and the motor 306. In some embodiments, washer 604 may be a washer that is designed to be located between a rotating surface and a stationary component and support the axial load to prevent movement along a shaft. In some embodiments, washer 604 may be designed to be used in high-wear application. In some embodiments, washer 604 may be a thrust washer. Next, washer 606 is placed over motor shaft 308*a* adjacent to washer 604 so that washer 604 is between washer 606 and bearing 602. In some embodiments, washer 606 may be designed to cushion joints and dampen vibrations. In some embodiments, washer 606 may be wool felt washers. Following washer 606, motor belt pulley 314 is placed over motor shaft 308*a* adjacent to washer 606 so that washer 606 is between washer 604 and motor belt pulley 314 such that washers 604, 606 prevent contact between motor belt pulley 314 and bearing 602. In this implementation, the motor belt pulley 314 serves a dual role, first, as a pulley for driving belt 320 and, second, as a set collar for motor shaft 308*a*. In some embodiments, motor belt pulley 314 may include holes 616 to insert a set screw to hold motor belt pulley 314 in place on motor shaft 308*a*. The set screw may be inserted into hole 616 and tightened until it pressed against the motor shaft 308*a* thereby holding motor belt pulley 314 in place. In some embodiments, the set screw may tighten against any portion of the motor shaft 308*a*. In some embodiments, motor shaft 308*a* may include a feature specifically designed to receive the set screw, such as for example a groove or a flat surface.

The anti-rotation stud 326 may be coupled to and extend from the housing of motor 306. In the illustrated embodiment, the anti-rotation stud 326 is disposed below the motor shaft 308*a* and extends in a direction parallel to the motor shafts 308*a*, 308*b*. It is contemplated that in some embodiments, the anti-rotation stud 326 may be disposed in a different location, such as above or to the side of either of the motor shafts 308*a*, 308*b*, such that it may be operable to resist rotation of the body of the motor 306. In the illustrated embodiment, the anti-rotation stud 326 may have a diameter of about ⅝ inch, however other sizes, both larger and smaller, are contemplated. In some embodiments, the anti-rotation stud 326 may be one discrete component. In some embodiments, the anti-rotation stud 326 may include two or more discrete components. In some embodiments, such as the embodiment in FIG. 7, the anti-rotation stud 326 may include a bolt 702. In some embodiments, the bolt 702 may be a ⅜-inch hex bolt. In some embodiments, the size of bolt 702 may be between about ⅛-inch and about ½-inch. Bolt 702 may be inserted into the housing of motor 306. In some embodiments, a sleeve 704 fits over bolt 702. In some embodiments, sleeve 704 may include a cushioning material designed to reduce contact between bolt 702 and side panel 302 in order to reduce vibration transfer and noise. In some embodiments, sleeve 704 may be a dampening material (e.g., rubber or polymeric material such as silicon tubing) having an outer diameter of about ⅝-inch and an inner diameter of about ⅜-inch, although other sizes, both larger and smaller, are contemplated. In some embodiments, anti-rotation stud 326 includes a standoff 706 that is coupled to the housing of the motor 306 and sized to receive bolt 702. The sleeve 704 may then slide over bolt 702 and standoff 706. Although one anti-rotation stud 326 is shown, other embodiments include more than one anti-rotation stud 326. For example, some embodiments, include an anti-rotation stud 326 extending from both sides of the motor.

Side panels 302 may include openings as slots 618 for receiving projections as anti-rotation studs 326. In the illustrated embodiment, the slots 618 extend from a bottom edge of side panels 302 upward to opening 612 to form one continuous opening having a narrow slot connected to a round head or opening 612. In some embodiments, slots 618 may be cut shorter than illustrated, being distinct and separate from openings 612. The slots 618 may have a width smaller than the bearing 602, and therefore the bearing is still maintained in the opening 612. In some implementations, the width of the opening in slots 618 may be about the same size as the diameter of anti-rotation studs 326. In some embodiments, the width of opening in slots 618 is about ⅝-inch. In some embodiments, the slots 618 may be wider than the diameter of anti-rotation studs 326. In some embodiments, slots 618 and anti-rotation studs 326 may be sized so that the anti-rotation studs 326 are press fit into slots 618, with an interference fit. In the illustrated embodiment, slots 618 have an opening of about ⅝-inch and anti-rotation studs 326 have a diameter of about ⅝-inch so that anti-rotation studs 326 are seated securely within slots 618. Although not required to be similar sizes, the secure seating allows the anti-rotation studs 326 to slide into slots 618 with minimal effort.

The slots 618 have inner edges that define their open area or width. The anti-rotation stud 326 may be sized to abut against the inner edges of the slots 618 without otherwise being secured to the side panels 302. Accordingly, the anti-rotation stud 326 may abut the edges of the slot 618 to inhibit or prevent rotation of the motor relative to the side panels without being fixedly secured to the side panel. That is, the secure seating or fit of the anti-rotation stud 326 into the slot 618 may prevents the anti-rotation studs from swinging side to side when motor 306 reverses direction, further dampening noise and vibration. Furthermore, the life of the anti-rotation stud 326 is prolonged because of the minimized impact from the lack of swing. In some embodiments, the slots 618 may be above the openings 614. The anti-rotation studs 326 may be located above the motor shafts 308*a*, 308*b* and fit within slots 618 that are above openings 614. In some embodiments, side panels 302 may include additional openings positioned and sized to receive anti-rotation studs 326 position in different configurations along the sides of motor 306.

As illustrated, the motor 306 may be suspended via the bearings 602 which are supported by openings 612 in side panels 302, thereby isolating the vibrations of motor 306 from the overall operator chassis. That is, the motor may be supported by the side panels without being fixedly attached to the side panels. Accordingly, the side panels (or the chassis including the side panels 302) may support the motor only through the motor shafts 308*a*, 308*b* and the anti-rotation stud 326. That is, in some implementations, only the motor shafts 308*a*, 308*b* and the anti-rotation stud engage, even indirectly, the side panels 302. Contact between motor shafts 308*a*, 308*b* and side panels 302 is reduced, or eliminated, through the use of the intermediate bearings 602 or other dampening materials. Therefore, vibrations caused by motor 306 and transmitted to side panels 302 are reduced, or eliminated, resulting a noise reduction. Axial movement of motor 306 (e.g., movement in a direction parallel to the motor shafts 308*a*, 308*b* is reduced, or eliminated, by the steps 614 which prevent motor 306 from contacting side walls 302. Washers 604, 606, 608, set collar 610, and motor belt pulley 314 further reduce, or eliminate, axial movement of motor 306 and dampen, or eliminate, contact between bearings 602 and set collar 610 and motor belt pulley 314. This reduction in axial movement and metal on metal contact further reduces vibrations and therefore reduces noise produce by jackshaft operator 300. Rotational movement of the body of motor 306 is reduced, or eliminated, by the anti-rotation studs 326 seated in slots 618. As illustrated, the anti-rotation studs 326 further isolate motor 306, reducing vibrations and contact from motor 306 to side panels 302, which further reduces noise. Radial movement of motor 306 caused by belt 320 is reduced, or eliminated, by the use of bearings 602 supporting motor 306. As illustrated, the load of belt 320 is supported entirely by side panels 302 through bearings 602 and belt transfer pulley 318 resulting in little, to no, radial load on motor 306. This reduction in radial load as compared to previous designs further reduces the transfer of vibrations from motor 306 to side panels 302, resulting in less noise. As described above, each mounting component of the motor mount assembly reduces contact between motor 306 and other components within jackshaft operator 300, including side panels 302. The reduced contact reduces vibrations in the chassis overall, and therefore reduces noise in jackshaft operator 300. Individually, the reduction in noise is an improvement over previous designs and together the net reduction in noise provides a better experience for the customer. In addition to the reduction in vibration and noise, there is a reduction in overall parts used resulting in a reduced cost to manufacture and assemble the jackshaft operator 300. As previously mentioned, the improvements discussed with respect to the illustrated embodiments of an exemplary jackshaft operator are applicable to at least hoist operators, trolley operators, and rail drive operators and are within the scope of this disclosure.

Figure 8:
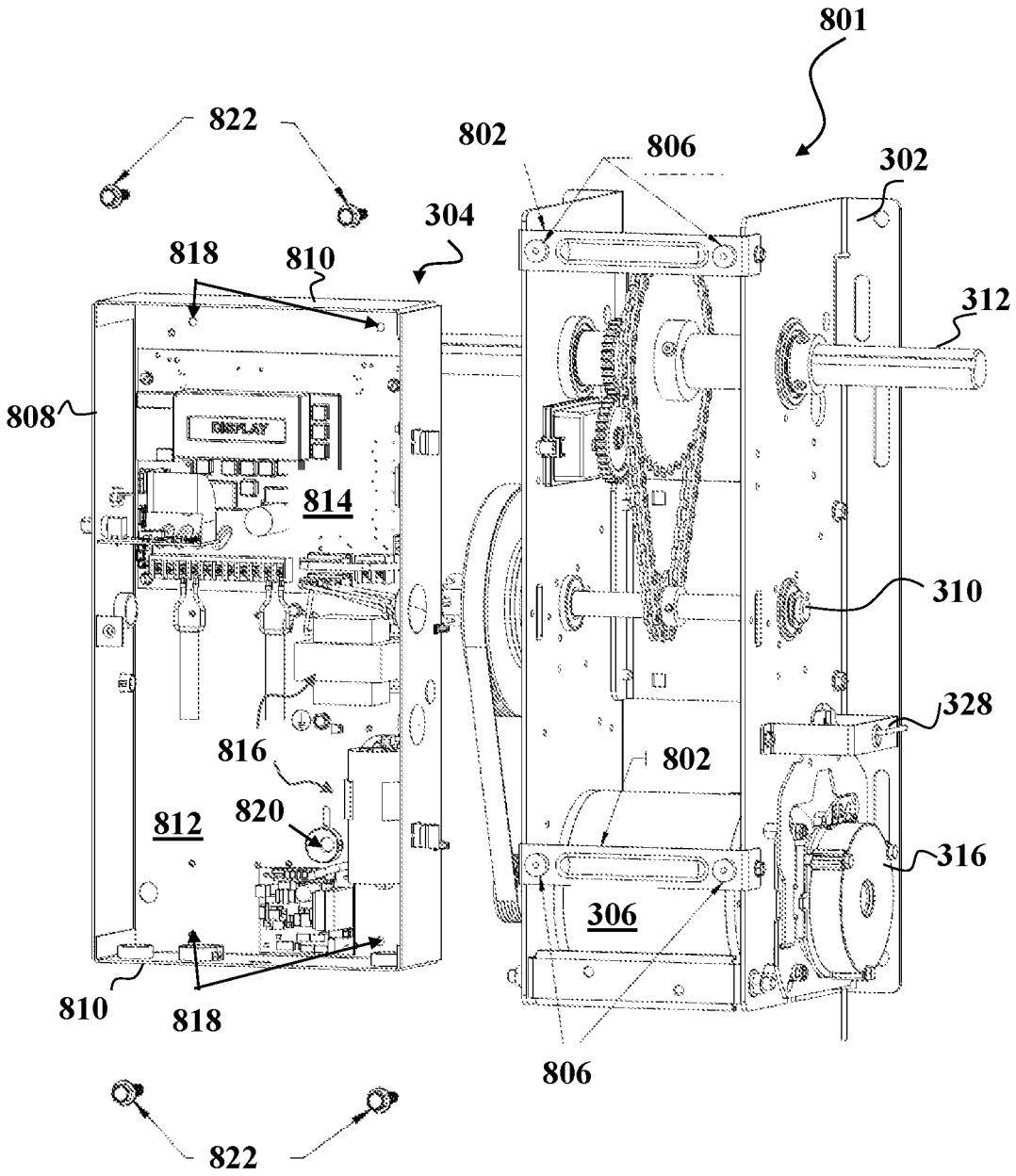
FIG. 8 is a perspective illustration of an electric box mounting for a jackshaft type motor drive assembly, according to one example implementation.

FIG. 8 depicts a perspective view electric box mounting components of an exemplary jackshaft operator. As depicted in FIG. 8, electric box 304 is depicted without a cover adjacent to an assembled operator chassis 801 including side panels 302, motor 306, and shafts 310,312. Brackets 802 are coupled to the side panels 302 of chassis 801. In the illustrated embodiment, an upper bracket 802 is attached to the side panels 302 using screws 804, with each screw 804 being used to attached one side of bracket 802 to the respective side panel 302. A lower bracket 802 is attached to side panels 302 in a similar manner to the upper bracket 802. In some embodiments, brackets 802 may be coupled to chassis 801 in different locations. In some embodiments, brackets 802 may be coupled to chassis 801 in a different manner such as a rivet, carrier bolt, etc.

Nuts 806 are inserted into holes in brackets 802 for securing electric box 304 to chassis 801. In the depicted embodiment, nuts 806 are isolation well nuts having a dampening (e.g., polymeric or rubber) head, or flange, a dampening body, and a threaded metal insert within the rubber body for receiving a flange, a rubber body, and a threaded insert contained within the rubber body. In some implementations, the dampening flange has a thickness of about ⅛-inch. The dampening flange and dampening body serve to reduce, or eliminate, the transfer of vibrations from the metal of the chassis 801 to the metal electric box 304. In some embodiments, nuts 806 may be different connector designed to physically isolate the electric box 304 from the chassis 801.

As depicted, electric box 304 is made of metal sidewalls 808, metal top and bottom walls 810, and a metal back panel 812. Electric box 304 contains a control board 814 and electronic components 816. The back panel 812 includes holes 818 operable for securing electric box 304 to chassis 801 and holes 820 operable to pass wires from control board 814 and electronic components 816 to motor 306 and brake 316.

Fasteners 822 are operable for coupling electric box 304 to chassis 801 using nuts 806. In the illustrated embodiment, fasteners 822 are screws that are sized to fit within the threaded insert of nuts 806. When fasteners 822 are tightened into nuts 806 the rubber flange swells providing separation between electric box 304 and chassis 801. This separation further isolates the vibration from motor 306 and results in further noise reduction during operation of jack-shaft operator 300. In some embodiments, fasteners 822 may be carriage bolts in combination with rubber washers to provide isolation. In some implementations, the electric box is coupled to the chassis 801 (and the brackets 802) only via vibration-dampening coupling elements, such as the nuts 806, so as to preclude metal to metal contact between the electrical box and the chassis.

Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

The present disclosure is directed to a movable barrier operator which includes a first side panel that has a first opening. The movable barrier operator further includes a second side panel opposite the that has a second opening and a third opening. The second opening is circular and the third opening is a slot that intersects the second opening so that second and third openings are joined. There is a motor for displacing a moveable barrier that is disposed between the first side panel and the second side panel without being fixedly attached to the first side panel or the second side panel. The motor includes a first shaft, a second shaft, and a third shaft. The first shaft extends away from the motor in a first direction and through the first opening. The second shaft extends away from the motor a second direction that is opposite the first direction and extends through the second opening. One of the first or second shafts transmits power from the motor to displace the moveable barrier. The motor further includes a projection that extends in the second direction through the third opening and abuts the inside edges of the third opening in a manner that prevents rotation of the motor relative to the first side panel and the second side panel. The projection includes a dampening bumper that abuts against the inside edges of the third opening. The motor is supported by a first bearing disposed in the first opening of the first side panel and a second bearing disposed in the second opening of the second side panel.

The movable barrier further includes a belt pulley that is coupled to the first shaft. The belt pulley receives a belt to drive the movable barrier and prevents movement of the motor in the first direction. A washer is disposed around the first shaft adjacent to the belt pulley on one side and the first bearing on the other side. The washer dampens vibration between the first bearing and the belt pulley. A set collar is coupled to the second shaft by a set screw to prevent movement of the motor in the second direction. A washer is disposed around the second shaft adjacent to the set collar on one side and adjacent the second bearing on the other side. The washer dampens vibration between the second bearing and the set collar. The movable barrier operator further includes a first bracket and a second bracket coupled to the first side panel and the second side panel. An electric box is coupled to the first and second brackets by only a dampening connector.

The present disclosure is further directed to a movable barrier operator which includes a chassis having a first side and an opposing second side. The first side includes a first opening and a second opening disposed below the first opening. The second side includes a third opening disposed opposite the first opening. A motor for displacing a moveable barrier includes a first shaft, a second shaft, and a stud. The first shaft extends in a first direction through the first opening. The second shaft extends in a second direction, that is opposite the first direction, through the third opening. The stud is disposed below the first shaft and through the second opening to prevent rotation of the motor relative to the first side and the second side. The chassis may include a fourth opening in the second side that is disposed below the third opening. The motor may include a second stud that is disposed below the second shaft and through the fourth opening. The chassis may support the motor only through the first shaft, the second shaft, and the stud. The stud may prevent rotational motion of the motor relative to the chassis.

The movable barrier operator may further include a bearing, a washer, and a belt pulley. The bearing is disposed within the first opening. One side of the washer is disposed adjacent the bearing and the washer may include a compressible material. The belt pulley is disposed adjacent the other side of the washer. The first shaft is disposed through the bearing, the washer, and the belt pulley. The first shaft may include a step at a proximal end of the shaft that extends a first distance towards the distal end of the first shaft. The first distance may be between 20 mm and 30 mm. An electric box may be coupled to the chassis through an isolation nut that includes rubber.

The present disclosure is further directed to a movable barrier operator that includes a chassis including a first side panel and an opposing second side panel. A first bracket is coupled to the first side panel and the second side panel and a second bracket is coupled to the first side panel and the second side panel. A first bearing is disposed within the first side panel. A second bearing disposed within the second side panel. The movable barrier operator further includes a motor that displaces a moveable barrier. The motor includes a first shaft and a second shaft. The first shaft may extend in a first direction along a first axis. The second shaft may extend in a second direction, opposite the first direction, along the first axis. The motor is disposed within the operator chassis and is suspended from the first bearing and the second bearing. An electric box is coupled to the operator chassis. The motor may include a stud the extends through an opening in the first side panel. The stud abuts against the edges of the opening without being fixed to the first side panel.

The movable barrier operator may further include a first washer, a second washer, a belt pulley coupled to the first shaft. A belt is wrapped around the belt pulley to drive so that the pulley drives the belt and the belt drives the movable barrier. The belt pulley may be disposed around the first shaft and adjacent to and contacting the second washer. The second washer may be contacting the first washer. The first washer may be contacting the first bearing. An electric box may be coupled to the operator chassis using a connector that includes a dampener.

What is claimed is:

1. A movable barrier operator, comprising:

a first side panel having a first opening;

a second side panel, opposing the first side panel, the second side panel having a second opening and a third opening;

a motor configured to displace a moveable barrier, the motor disposed between the first side panel and the second side panel without being fixedly attached to the first side panel or the second side panel, the motor comprising:

a first shaft extending in a first direction away from the motor through the first opening;

a second shaft extending in a second direction opposite the first direction through the second opening, one of the first shaft and the second shaft being configured to transmit power from the motor to displace the moveable barrier; and a projection extending in the second direction through the third opening and configured to abut inside edges of the third opening in a manner that prevents rotation of the motor relative to the first side panel and the second side panel;

a first bearing disposed in the first opening of the first side panel and supporting the motor; and a second bearing disposed in the second opening of the second side panel and supporting the motor.

2. The movable barrier operator of claim 1, wherein the second opening and the third opening are joined, the second opening being substantially circular, the third opening being a slot intersecting the second opening.

3. The movable barrier operator of claim 1, wherein the projection comprises a dampening bumper that abuts against the inside edges of the third opening.

4. The movable barrier operator of claim 1, further comprising:

a belt pulley coupled to the first shaft, operable to receive a belt to drive the movable barrier, wherein the belt pulley prevents movement of the motor in the first direction.

5. The movable barrier operator of claim 4, further comprising:

a washer disposed around the first shaft, wherein a first side of the washer is adjacent to the belt pulley, wherein an opposing second side of the washer is adjacent to the first bearing, wherein the washer dampens a vibration between the first bearing and the belt pulley.

6. The movable barrier operator of claim 1, further comprising:

a set collar coupled to the second shaft, wherein the set collar includes a set screw for coupling the set collar to the second shaft to prevent movement of the motor in the second direction; and a washer disposed around the second shaft, wherein a first side of the washer is adjacent to the set collar, wherein an opposing second side of the washer is adjacent to the second bearing, wherein the washer dampens a vibration between the second bearing and the set collar.

7. The movable barrier operator of claim 1, further comprising:

a first bracket coupled to the first side panel and the second side panel;

a second bracket coupled to the first side panel and the second side panel; and an electric box coupled to the first bracket and the second bracket, the electric box being coupled only via a dampening connector to the first bracket and the second bracket.

8. A movable barrier operator, comprising:

a chassis including a first side and an opposing second side;

the first side including a first opening and a second opening, wherein the second opening is disposed below the first opening;

the second side including a third opening disposed opposite the first opening; and a motor configured to displace a moveable barrier, the motor including a first shaft, a second shaft, and a stud, wherein the first shaft extends in a first direction, wherein the second shaft extends in a second direction opposite the first direction, wherein the stud is disposed below the first shaft, wherein the first shaft is disposed through the first opening without being fixedly attached to the chassis, wherein the stud is disposed through the second opening without being fixedly attached to the chassis, and wherein the second shaft is disposed through the third opening without being fixedly attached to the chassis, the stud being configured to prevent rotation of the motor relative to the first side and the second side.

9. The movable barrier operator of claim 8, further comprising:

the second side further including a fourth opening, wherein the fourth opening is disposed below the third opening; and the motor further including a second stud, wherein the second stud is disposed below the second shaft, and wherein the second stud is disposed through the fourth opening.

10. The movable barrier operator of claim 8, wherein the first shaft includes a step at a proximal end of the shaft, wherein the step extends a first distance towards a distal end of the first shaft.

11. The movable barrier operator of claim 10, wherein the first distance is between 20 mm and 30 mm.

12. The movable barrier operator of claim 8, further comprising:

an isolation nut coupled to the chassis, wherein the isolation nut includes rubber; and an electric box coupled to the chassis using the isolation nut.

13. The movable barrier operator of claim 8, wherein the chassis is arranged to support the motor only through the first shaft, the second shaft, and the stud, the stud being arranged to prevent rotational motion of the motor relative to the chassis.

14. A movable barrier operator, comprising:

a chassis including a first side and an opposing second side;

the first side including a first opening and a second opening, wherein the second opening is disposed below the first opening;

the second side including a third opening disposed opposite the first opening;

a motor configured to displace a moveable barrier, the motor including a first shaft, a second shaft, and a stud, wherein the first shaft extends in a first direction, wherein the second shaft extends in a second direction opposite the first direction, wherein the stud is disposed below the first shaft, wherein the first shaft is disposed through the first opening, wherein the stud is disposed through the second opening, and wherein the second shaft is disposed through the third opening and configured to prevent rotation of the motor relative to the first side and the second side;

a bearing;

a washer, wherein the washer includes a compressible material; and a belt pulley, wherein the bearing is disposed within the first opening, wherein the washer is disposed adjacent the bearing, wherein the belt pulley is disposed adjacent the washer, wherein a first face of the washer is adjacent the bearing, wherein an opposing second face of the washer is adjacent the belt pulley, and wherein the first shaft is disposed through the bearing, the washer, and the belt pulley.

15. A movable barrier operator, comprising:

a chassis including a first side panel, an opposing second side panel, a first bracket coupled to the first side panel and the second side panel, and a second bracket coupled to the first side panel and the second side panel;

a first bearing disposed within the first side panel;

a second bearing disposed within the second side panel;

a motor configured to displace a moveable barrier, the motor including a first shaft and a second shaft, wherein the motor is disposed within the operator chassis, wherein the motor is suspended from the first bearing and the second bearing; and an electric box coupled to the operator chassis, wherein the motor further includes a stud disposed through an opening in the first side panel, the stud configured to abut against edges of the opening without being fixedly secured to the first side panel.

16. A movable barrier operator, comprising:

a chassis including a first side panel, an opposing second side panel, a first bracket coupled to the first side panel and the second side panel, and a second bracket coupled to the first side panel and the second side panel;

a first bearing disposed within the first side panel;

a second bearing disposed within the second side panel;

a motor configured to displace a moveable barrier, the motor including a first shaft and a second shaft, wherein the motor is disposed within the operator chassis, wherein the motor is suspended from the first bearing and the second bearing;

an electric box coupled to the operator chassis;

a belt pulley coupled to the first shaft; and a belt wrapped around the belt pulley, wherein the belt pulley drives the belt and the belt drives the movable barrier.

17. The movable barrier operator of claim 16, wherein the first shaft extends in a first direction along a first axis, wherein the second shaft extends in a second direction along the first axis, wherein the second direction is opposite the first direction.

18. The movable barrier operator of claim 16, further comprising:

a connector for coupling the electric box to the operator chassis, wherein the connector includes dampener.

19. A movable barrier operator, comprising:

a chassis including a first side panel, an opposing second side panel, a first bracket coupled to the first side panel and the second side panel, and a second bracket coupled to the first side panel and the second side panel;

a first bearing disposed within the first side panel;

a second bearing disposed within the second side panel;

a motor configured to displace a moveable barrier, the motor including a first shaft and a second shaft, wherein the motor is disposed within the operator chassis, wherein the motor is suspended from the first bearing and the second bearing;

an electric box coupled to the operator chassis;

a first washer disposed around the first shaft;

a second washer, the first washer including wool felt, wherein the second washer is disposed around the first shaft; and a belt pulley disposed around the first shaft, where the first washer is contacting the first bearing, wherein the second washer is contacting the first washer, and wherein the belt pulley is contacting the second washer.

* * * * *